US005332519A

United States Patent [19]

Mazzola

[11] Patent Number: 5,332,519

[45] Date of Patent: Jul. 26, 1994

[54] DETERGENT COMPOSITION THAT DISSOLVES COMPLETELY IN COLD WATER, AND METHOD FOR PRODUCING THE SAME

[75] Inventor: Louis Mazzola, Mahwah, N.J.

[73] Assignee: Church & Dwight Co., Inc., Princeton, N.J.

[21] Appl. No.: 887,548

[22] Filed: May 22, 1992

[51] Int. Cl.[5] ..... C11D 17/00; C11D 1/66; C11D 3/10

[52] U.S. Cl. ..... 252/174; 252/174.14; 252/174.23; 252/174.18; 252/551

[58] Field of Search ..... 252/174, 174.14, 174.23, 252/174.18, 551

[56] References Cited

U.S. PATENT DOCUMENTS

| | | | |
|---|---|---|---|
| 2,364,767 | 12/1944 | Zizinia et al. | 252/161 |
| 3,213,029 | 10/1965 | Muchow et al. | 252/99 |
| 3,764,541 | 10/1973 | Kaneko | 252/89 |
| 3,793,228 | 2/1974 | Kandler et al. | 252/541 |
| 3,838,072 | 9/1974 | Smith, Jr. et al. | 252/540 |
| 3,886,098 | 5/1975 | DiSalvo et al. | 252/540 |
| 3,926,827 | 12/1975 | Mangeli | 252/99 |
| 4,000,080 | 12/1976 | Bartolotia et al. | 252/99 |
| 4,059,538 | 11/1977 | Green et al. | 252/95 |
| 4,077,897 | 3/1978 | Gault | 252/99 |
| 4,169,806 | 10/1979 | Davis et al. | 252/99 |
| 4,260,651 | 4/1981 | Wixon | 427/214 |
| 4,265,790 | 5/1981 | Winston et al. | 252/135 |
| 4,269,722 | 5/1981 | Joshi et al. | 252/90 |
| 4,347,152 | 8/1982 | Wixon | 252/174 |
| 4,399,049 | 8/1983 | Gray et al. | 252/91 |
| 4,411,809 | 10/1983 | Wixon | 252/91 |
| 4,414,130 | 11/1983 | Cheng | 252/140 |
| 4,427,417 | 1/1984 | Porasik | 23/313 R |
| 4,552,681 | 11/1985 | Koch et al. | 252/140 |
| 4,639,326 | 1/1987 | Czempik et al. | 252/91 |
| 4,652,391 | 3/1987 | Balk | 252/99 |
| 4,663,194 | 5/1987 | Wixon | 427/214 |
| 4,664,817 | 5/1987 | Wixon | 252/8.8 |
| 4,695,284 | 9/1987 | Hight | 8/137 |
| 4,711,740 | 12/1987 | Carter et al. | 252/174.24 |
| 4,713,193 | 12/1987 | Tai | 252/91 |
| 4,720,399 | 1/1988 | Taha | 427/221 |
| 4,726,908 | 2/1988 | Kruse et al. | 252/91 |
| 4,800,055 | 1/1989 | Klee et al. | 264/118 |
| 4,826,632 | 5/1989 | Blackburn et al. | 252/550 |
| 4,828,721 | 5/1989 | Bollier et al. | 252/8.7 |
| 4,853,259 | 8/1989 | Taha | 427/221 |
| 4,883,833 | 11/1989 | Hughes | 524/394 |
| 5,034,147 | 7/1991 | Ramachandran | 252/95 |

FOREIGN PATENT DOCUMENTS

| | | | |
|---|---|---|---|
| 0466484 | 1/1992 | European Pat. Off. | 252/174 |
| 3438654 | 5/1985 | Fed. Rep. of Germany | 252/174 |
| 9102047 | 7/1990 | World Int. Prop. O. | 252/174 |

*Primary Examiner*—Paul Lieberman
*Assistant Examiner*—Michael Tierney
*Attorney, Agent, or Firm*—Bryan Cave

[57] ABSTRACT

Detergent compositions are disclosed that dissolve completely in cold water. In particular, detergents are disclosed comprising coarse particles having a high bulk density range and a high diameter to density ratio. Processes for the production of such detergents are also disclosed.

10 Claims, No Drawings

DETERGENT COMPOSITION THAT DISSOLVES COMPLETELY IN COLD WATER, AND METHOD FOR PRODUCING THE SAME

FIELD OF THE INVENTION

This invention relates to detergent compositions that dissolve completely in cold water, and methods for producing such detergents. In particular, this invention relates to detergents comprising coarse particles having a high bulk density range and a high diameter to density ratio.

BACKGROUND

It is often advantageous to wash laundry in cold water (e.g., temperatures from about 2–24° C.). Washing in cold water generally conserves energy, and therefore costs less money than washing in warm water. Other advantages include potentially less damage to clothes.

Such advantages must often be balanced against the fact that detergents tend to form residues in cold water. Such residues are only slowly soluble in cold water. As a result, efficacy may be lost because the active ingredients are not fully in solution. Also, residues may remain at the completion of automatic washing cycles requiring additional work to clean automatic washing machines.

Winston et al. (U.S. Pat. No. 4,265,790) substantially eliminated the problem of cold water residue of silicate containing compositions by replacing fine, granular silicate with coarse, granular silicate in a dry blended laundry detergent. Muchow et al. (U.S. Pat. No. 3,213,029) improved the solubility of granular compositions containing chlorocyanuric acid by providing dense, physically stable, granular compositions.

However, the compositions of the prior art have not proven entirely satisfactory as they generally address the solubility of a specific ingredient in tepid water. Residues still generally form at very cold water temperatures (e.g., temperatures from about 2–12° C.). This is due to the fact that particle size or density alone will not completely determine cold water solubility. Furthermore, the prior art does not teach or disclose non-residue compositions for the broad class of detergents comprising large amounts of carbonate and/or bicarbonate builders. Also, formulations containing high levels of hydratable ingredients exhibit extremely poor solubility in cold water. These are problems not addressed by the prior art.

It has now been discovered that cold water residues will not form in detergents comprising coarse particles having a high bulk density provided the particle diameter to density ratio criteria, as disclosed herein, is applied. It has been found that for all detergent compositions there exist particle diameter to density ratios which will provide complete solubility in cold water. Whereas prior art has specified particle size or density restrictions, the present disclosure requires only that these parameters exceed a minimum ratio. This is a surprising result as one trained in the art would hesitate to create large, dense detergent particles knowing the potential for insolubility. Conceptually, formulas comprising small granules, with large surface area, should dissolve rapidly.

SUMMARY OF THE INVENTION

A detergent composition, and method for producing the same, have now been developed that overcome the above-noted problems and also have numerous other advantages that will be apparent to those skilled in the art.

One aspect of the present invention concerns a particulate detergent composition capable of dissolving completely in cold water. The composition can comprise particles having a weighted average particle diameter of from about 1300–2100 microns, a bulk density of from about 600–1050 grams/liter, and a weighted average particle diameter to bulk density ratio of from about 1.39–2.60 (microns)(liter)/gram. Preferably, the bulk density will be from about 800–1000 gram/liter and/or the ratio will be from about 1.68–1.88 (microns)(liter)/gram. The composition will be capable of completely dissolving in cold water having a temperature of from about 2–24° C., preferably from about 2–12° C.

Another aspect of the present invention concerns a particulate detergent composition capable of dissolving completely in water and comprising not less than 50 weight percent of hydratable components. The composition will comprise particles having a weighted average particle size of from about 1300–2100 microns, a bulk density of from about 600–1050 grams/liter, and a weighted average particle diameter to bulk density ratio of from about 1.39–2.60 (microns)(liter)/gram. In preferred embodiments bulk density will be from about 800–1000 gram/liter and/or the ratio will be from about 1.68–1.88 (microns)(liter)/gram. The composition may further comprise from about 4–6 weight percent sodium ether sulfate, from about 1–4 weight percent ethoxylated alcohol, from about 1–3 weight percent sodium sulfate, from about 1–3 weight percent sodium bicarbonate, and from about 5–10 weight percent water and/or minor amounts of additives such as polymer solids, brighteners, perfumes, polyvinyl alcohol, and combinations of the foregoing. In preferred embodiments, the composition will comprise the following materials in approximate amounts by weight percent:

| | weight percent |
|---|---|
| Sodium Carbonate | 81.90 |
| Sodium Ether Sulfate | 4.30 |
| Ethoxylated Alcohol | 2.40 |
| Sodium Sulfate | 1.50 |
| Sodium Bicarbonate | 1.30 |
| Polymer Solids | 0.70 |
| Sodium Carboxymethylcellulose | 0.10 |
| Optical Brightener | 0.20 |
| Perfume | 0.10 |
| Polyvinyl Alcohol | 0.10 |
| Water | 7.40 |
| | 100.00 |

Another preferred embodiment comprises the following materials in approximate amounts by weight percent:

| | weight percent |
|---|---|
| Sodium Carbonate | 78.40 |
| Sodium Ether Sulfate | 5.80 |
| Ethoxylated Alcohol | 3.20 |
| Sodium Sulfate | 2.00 |
| Sodium Bicarbonate | 1.80 |
| Polymer Solids | 0.90 |
| Sodium Carboxymethylcellulose | 0.10 |
| Optical Brightener | 0.20 |
| Perfume | 0.10 |
| Polyvinyl Alcohol | 0.10 |
| Water | 7.40 |

-continued

| | weight percent |
|---|---|
| | 100.00 |

The composition will completely dissolve in cold water having a temperature of from about 2-24° C., preferably from about 2-12° C.

Another aspect of the present invention concerns a process for producing a particulate detergent composition capable of completely dissolving in cold water. The process comprises: (a) blending raw materials to produce detergent particles, wherein said raw materials comprise not less than 50 percent by weight sodium carbonate, sodium bicarbonate, or combinations thereof; (b) agglomerating the detergent particles to produce agglomerated particles; (c) compacting the agglomerated detergent particles to produce cohesive sheets, pellets, or sticks; and (d) granulating and screening the sheets, pellets, or sticks to produce a particulate detergent composition having a bulk density of from about 600-1050 grams/liter, a weighted average particle size of from about 1300-2100 microns, and a weighted average particle diameter to bulk density ratio of from about 1.39-2.60 (microns)(liter)/gram. The process will preferably utilize the particulate detergent having a bulk density of from about 800-1000 grams/-liter and/or a ratio of from about 1.68-1.88 (microns)-(liter)/gram. The particulate detergent will be capable of completely dissolving in water having a temperature from about 2-24°, preferably from about 2-12° C.

DETAILED DESCRIPTION OF THE INVENTION

The particulate detergent compositions of the present invention dissolve completely in cold water. Cold water is defined as water having a temperature of from about 2-24° C. Preferred embodiments will dissolve completely in water having a temperature of from about 2-18° C.; more preferably from about 2-12°; and most preferably from about 2-8° C.

Complete dissolution (or "capable of dissolving completely") means that at the end of a wash cycle no detergent residue remains.

The particulate detergent of the present invention comprises coarse particles, defined as having a weighted average particle diameter of from about 1300-2100 microns; preferably from about 1500-1900 microns.

The high bulk density of the detergent is defined as from about 600-1,050 grams/liter; preferably from about 800-1000 grams/liter; more preferably from about 850-950 grams/liter.

The weighted average particle diameter to bulk density ratio of the detergent of the present invention is high, defined as from about 1.39-2.60 (microns)(liter)/-gram, preferably from about 1.68-1.88, and especially preferably about 1.8-2.2 (microns) (liter)/gram.

The ingredients of the present invention can vary widely. Preferred embodiments comprise large amounts of carbonate and/or bicarbonate builders, meaning more than 50 weight percent carbonate and/or bicarbonate builders; preferably more than 75 weight percent carbonate and/or bicarbonate builders. The carbonate and bicarbonate builders are preferably sodium salts, but other water soluble alkali metal carbonates and bicarbonates may be employed, at least in part. For instance, potassium carbonate and potassium bicarbonate may be employed. Such may be in anhydrous, hydrated or partially hydrated state. Sodium sesquicarbonate may be used in partial or complete replacement of the carbonate and bicarbonate. The sodium carbonate is especially preferably soda ash.

The present invention may comprise either carbonate or bicarbonate builders or mixtures thereof. If mixtures are utilized the proportion of alkali metal carbonate to alkali metal bicarbonate, by weight, will generally be within the range of 200:1 to 5:1, preferably being within the range of 40:1-10:1, more preferably from 25:1 to 16:1. The total amount of carbonate may be from about 40 to about 90 percent, preferably from about 50 to about 80 percent.

Other detergent builder materials may optionally be included in the detergent. For example, inorganic builders such as the following may be used: pyrophosphate, tripolyphosphate, orthophosphate, carbonate, sulfate, perborate monohydrate, silicate, sesquicarbonate, borate, and aluminosilicate. Organic builders such as the following may be used: sodium and potassium salts of citrate, amino polycarboxylates, nitrilotriacetates, N-(2-hydroxyethyl)- nitrilodiacetates, ethylenediamine tetraacetates, hydroxyethylenediamine tetraacetates, diethylenetriamino pentaacetates, dihydroxyethyl glycine, phytates, polyphosphonates, oxydisuccinates, oxydiacetates, carboxymethyloxysuccinates, hydrofuran tetracarboxylates, esterlinked carboxylate derivatives of polysaccharides such as the sodium and potassium starch maleates, cellulose phthalates, glycogen succinates, semi-cellulose diglycolates, starch, and oxidized heteropolymeric polysaccharides.

A silicate detergent builder, if present, may be an alkali metal silicate, such as sodium silicate having a weight ratio of $SiO_2$:$Na_2O$ of from about 1.8:1 t 3.75:1, preferably from about 2.0:1 to about 3.22:1. A preferred alkali metal silicate is sodium silicate. Such builder may be present in amounts of from about 0 to 20 percent, preferably from about 2 to 15 percent.

One or more nonionic surfactants may be included in the detergent of the present invention. Suitable nonionic surfactant compounds may fall into several different chemical types. Preferred nonionic surfactants are polyoxyethylene or polyoxypropylene condensates of organic compounds. Examples of preferred nonionic surfactants are:

(a) Polyoxyethylene or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acid (derived from coconut oil) which contains an average of about 12 carbon atoms, "tallow" fatty acids (derived from tallow-class fats) which contains an average of about 18 carbon atoms, palmitic acid, myristic acid, stearic acid and lauric acid;

(b) Polyoxyethylene or polyoxypropylene condensates of aliphatic alcohols, whether linear- or branched-chain and unsaturated or saturated, containing from about 8 to about 24 carbon atoms and incorporating from about 5 to about 50 ethylene oxide or propylene oxide units. Suitable alcohols include the "coconut" fatty alcohol (derived from coconut oil), "tallow" fatty alcohol (derived from the tallow-class fats), lauryl alcohol, myristyl alcohol, and oleyl alcohol.

An especially preferred nonionic surfactant is an alkoxylated linear alcohol having the following composition:

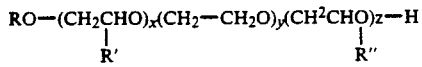

wherein R is a $C_6$–$C_{10}$ linear alkyl mixture, R′ and R″ are methyl, x averages 3, y averages 12 and z averages 16. Such an alkoxylated linear alcohol is sold by BASF Corp. under the trademark "INDUSTROL DW 5", and is described in U.S. Pat. No. 4,464,281, col. 5, lines 55 et seq. Other suitable nonionic surfactants are described in U.S. Pat. Nos. 4,169,806 and 3,764,541.

The nonionic surfactant may be present in amounts generally of from about 0 to about 50 percent by weight. A preferred range is from about 1 to about 15 percent by weight. Especially preferred is from about 2.0–10.0 percent by weight.

A polymer additive may optionally be included in the detergent of the present invention. For instance, a number of different polycarboxylic polymers or copolymers may be used. The polycarboxylic dispersants are generally organic substances having at least three carboxylic groups, and may be selected from the group consisting of ethylene-maleic anhydride copolymer, methyl vinyl ether-maleic anhydride copolymer, citric acid, nitrilotriacetic acid, ethylenediamine tetraacetic acid, carboxymethyloxy succinic acid and salts of said copolymers and acids, and mixtures thereof. Both linear and cross-linked copolymers may be utilized.

A preferred polymer additive is a polyacrylate polymer blend comprising a 75/25 weight percent blend of a sodium polyacrylate having a molecular weight of 4500 and a copolymer of maleic acid with an olefin having a molecular weight of 1500. In an especially preferred embodiment, the sodium polyacrylate is "ACUSOL 445ND", and the copolymer of maleic acid with an olefin is "ACUSOL 460ND". "ACUSOL" is a trademark of Rohm & Haas Company.

The polymer additive may be present in amounts of about 0 to about 5 percent by weight of final product, preferably from about 0.1 to about 2.5 percent, and especially preferably from about 0.5–1.5 percent by weight. The polymer additives are relatively expensive, and the amount of polymer additive, if present, will generally be limited by the cost of the polymer additive.

Water may be present in the detergent either in combination with hydrated or partially hydrated carbonate and/or bicarbonate builder, or as a separate ingredient. Water may be present in total amounts of from about 1–15 weight percent, preferably from about 3–10 weight percent.

Other minor components may optionally be included in the detergent. For instance, peroxy-bleach agents along with their activators, suds-controlling agents and suds boosters may be included. Anti-tarnishing agents, dyes, buffers, crystal modifiers, perfumes, anti redeposition agents, anionic surfactants, brighteners, colorants, and fluorescers may also be included.

Two especially preferred detergent compositions according to the present invention are as follows:

| | weight percent |
|---|---|
| Sodium Carbonate | 81.90 |
| Sodium Ether Sulfate | 4.30 |

-continued

| | weight percent |
|---|---|
| Ethoxylated Alcohol | 2.40 |
| Sodium Sulfate | 1.50 |
| Sodium Bicarbonate | 1.30 |
| Polymer Solids | 0.70 |
| Sodium Carboxymethylcellulose | 0.10 |
| Optical Brightener | 0.20 |
| Perfume | 0.10 |
| Polyvinyl Alcohol | 0.10 |
| Water | 7.40 |
| | 100.00 |
| Sodium Carbonate | 78.40 |
| Sodium Ether Sulfate | 5.80 |
| Ethoxylated Alcohol | 3.20 |
| Sodium Sulfate | 2.00 |
| Sodium Bicarbonate | 1.80 |
| Polymer Solids | 0.90 |
| Sodium Carboxymethylcellulose | 0.10 |
| Optical Brightener | 0.20 |
| Perfume | 0.10 |
| Polyvinyl Alcohol | 0.10 |
| Water | 7.40 |
| | 100.00 |

The process of the present invention generally comprises blending the components in a suitable powder blender, agglomerting the blended particles, compacting the agglomerated detergent particles to produce compacted sheets, and then granulating the compacted sheets to produce particles having a bulk density of from about 600–1,050 grams/liter, a weighted average particle diamter of from about 1300–2100 microns and a weighted average particle diameter to bulk density ration of form about 1.39–2.60 (microns) (liter)/gram.

Agglomeration methods are well known to those skilled in the art. Agglomeration may be carried out in any apparatus suitable for the mixing of the dry particulate components and adopted so that liquid components may be sprayed on, or otherwise added to, a bed or falling curtain of one or more particulate components during the mixing operation. Any suitable mixing device such as an inclined pan agglomerator, a rotating drum or any other vessel with suitable means of agitation may be used. Methods of agitating, mixing and agglomerating particulate components are well-known to those skilled in the art. The apparatus may be designed or adapted for either continuous or batch operation.

Compacting may be performed by applying pressure to the blended unagglomerated raw materials. It may be performed by continuously admitting the blended raw materials to a zone wherein the materials are subjected to pressure between two rolls running oppositely with respect to each other. A preferred means of compacting is by a roller compactor, wherein the materials are subjected to pressure between two rolls under an adjustable compacting pressure. An especially preferred compactor is the Fitzpatrick Company "CHILSONATER" roll compactor. The gap between the rolls and the amount of raw materials introduced to such a roll compactor can be adjusted to produce cohesive detergent sheets or pellets of desired densities.

Granulating can be performed by any suitable granulating or crushing means. The resulting compacted sheets, pellets, or sticks may be crushed to a desired weighted average particle diameter range of 1300–2100 microns. Preferably, the compacted sheets, pellets, or sticks are fed through a sieve crusher to force the compacted materials through a sieve with meshes of a given size determining the particle size of the final product.

Screening, if desired, can be performed by any suitable screening device. For instance, the crushed material may be screened to separate oversized and undersized particles in conventional oscillating sieves. The oversized and undersized particles may be recycled into the process.

The following examples illustrate but do not limit the invention.

EXAMPLES 1-5

A series of examples will illustrate the residue forming propensity of five different formulations relative to their weighted average particle diameter to bulk density ratios.

Tests were conducted as follows: a Maytag washer at the normal setting, cold water wash/cold water rinse cycle was used. The fabric load included one shirt, one pair of blue jeans, three bath towels, two pillow cases and one double sheet. Water temperature was set at 40° F.

With the use of a separate water chiller system and a storage tank, a sufficient supply of 40° F. water is made available for the test. With the washing machine empty, the detergent formulation under test was added to the machine by making a mound on the bottom rear of the tub of the machine. Next the fabric load, identified above, was added, water turned on, and the machine was started. The water temperature was recorded at intervals of 1, 5 and 9 minutes (over a 10 minute wash cycle). The machine was allowed to run through a complete cycle including wash, rinse and spin and the clothes thus washed were carefully removed from the machine by shaking them in the machine so that any undissolved product lumps remained in the machine. Lumps remaining in the machine were collected and weighed and the weight recorded.

Formulation 1 was prepared by agglomerating the following raw materials in the indicated weight percent.

| | weight percent |
|---|---|
| Sodium Carbonate | 81.94 |
| Sodium Ether Sulfate | 4.30 |
| Ethoxylated Alcohol | 2.40 |
| Sodium Sulfate | 1.50 |
| Sodium Bicarbonate | 1.30 |
| Polymer Solids | 0.70 |
| Sodium Carboxymethylcellulose | 0.10 |
| Optical Brightener | 0.20 |
| Perfume | 0.10 |
| Polyvinyl Alcohol | 0.06 |
| Water | 7.40 |
| | 100.00 |

This formulation was found to have a bulk density of 615 grams/liter and a weighted average particle diameter of 394 microns. The particle diameter-to-density ratio is therefore 0.64, The formula was tested according to the method described above for its propensity to leave residues in the washing machine, After the test the weight of residue was found to be 6.1 grams.

The same product was compacted into solid sheets of product, granulated, and screened to yield a product with a bulk density of 945 and a weighted average particle diameter of 1600 microns. The particle diameter-to-density ratio of this product is therefore 1.69.

After conducting the residue test as described above in the washing machine, no residue could be found, indicating complete solubility.

Formulation 2, indicated below, was prepared by methods similar to formulation 1.

| | weight percent |
|---|---|
| Sodium Carbonate | 81.54 |
| Sodium Ether Sulfate | 5.80 |
| Ethoxylated Alcohol | 3.20 |
| Sodium Sulfate | 2.00 |
| Sodium Bicarbonate | 1.10 |
| Polymer Solids | 0.90 |
| Sodium Carboxymethylcellulose | 0.10 |
| Optical Brightener | 0.20 |
| Perfume | 0.10 |
| Polyvinyl Alcohol | 0.06 |
| Water | 5.00 |
| | 100.00 |

After agglomeration, the formula was determined to have a weighted average particle diameter of 454 microns and a bulk density of 640 grams/liter. The diameter-to-density ratio was therefore 0.71. The cold water residue test described above was performed, and a residue of 10.0 grams remained.

The same material of formulation 2 was then compacted and granulated to form particles with a weighted average diameter of 1052 microns and a bulk density of 970 grams/liter. The diameter-to-density ratio was thus 1.08. After the cold water residue test, a residue of 4.9 grams remained.

Additional compaction and granulation produced particles with an average weighted diamter of 1605 microns and a bulk density of 912 grams/liter. The diameter-to-density ratio was thus increased to 1.76. The cold water residue test was performed, and no residue remained.

Formulation 3, a competitive product, was analyzed and found to contain the following materials by weight percent:

| | weight percent |
|---|---|
| Sodium Carbonate | 68.50 |
| Sodium Alkylbenzenesulfonate | 6.30 |
| Ethoxylated Alcohol | 7.40 |
| Sodium Silicate | 5.10 |
| Sodium Phosphate | 2.60 |
| Sodium Carboxymethylcellulose | 0.10 |
| Sodium Sulfate | 1.00 |
| Water | 9.00 |
| | 100.00 |

This formula was found to have a bulk density of 655 grams/liter and a weighted average particle diameter of 609 microns. The diameter-to-density ratio was therefore 0.93. Cold water residue tests indicated a residue weight of 15.5 grams.

This formula was then compacted and granulated to produce a product with granules having a weighted average particle diamter of 1605 microns and a bulk density of 912 grams/liter. Thus, the diameter-to-density ratio was 1.76. The cold water residue test was performed, and no residue remained.

Formulation 4, a competitive product, was analyzed and found to contain the following materials by weight percent:

| | weight percent |
|---|---|
| Sodium Carbonate | 80.30 |
| Sodium Sulfate | 1.00 |
| Sodium Phosphate | 2.20 |
| Sodium Silicate | 3.30 |
| Sodium Carboxymethylcellulose | 0.10 |
| Ethoxylated Alcohol | 5.00 |
| Water | 8.10 |
| | 100.00 |

This formulation was determined to have a bulk density of 905 grams/liter and a weighted average particle diameter of 515 microns. Thus, the particle diameter-to-density ratio of 0.57. The cold water residue test was performed and a residue of 27.5 grams remained.

This formulation was then compacted and granulated to produce granules with a weighted average particle diameter of 1370 microns and a bulk density of 615 grams/liter. Thus the diameter-to-density ratio was 2.23. A cold water residue test of this product produced no residue.

Formulation 5, a competitive product, was analyzed and found to contain the following materials by weight percent:

| | weight percent |
|---|---|
| Sodium Carbonate | 13.10 |
| Sodium Tripolyphosphate | 44.80 |
| Zeolite | 0.30 |
| Sodium Sulfate | 1.70 |
| Optical Brightener | 0.0 |
| Perfume | 0.10 |
| Sodium Carboxymethylcellulose | 0.15 |
| Sodium Alkylbenzenesulfonate | 11.60 |
| Ethoxylated Alcohol | 5.30 |
| Sodium Silicate | 3.00 |
| Enzyme | 0.15 |
| Water | 19.75 |
| | 100.00 |

The weighted average particle diameter was found to be 610 microns, and the bulk density was found to be 850 grams/liter. Thus, the particle diameter-to-density ratio was 0.72. The cold water residue test was performed, and a residue of 2.6 grams remained.

Formulation 5 was then compacted and granulated, producing a product with a bulk density of 900 grams/-liter and a weighted average particle diameter of 1600 microns. Thus, the particle diameter-to-density ratio was 1.78. The cold water residue test was performed and no residue remained.

As can be seen from the five examples, detergent compositions comprising coarse particles with high bulk density as defined by the present invention will exhibit no cold water residue. Formula particles possessing low particle diameter-to-density ratios will have a propensity to produce cold water residues.

All of the patents and other references identified herein are incorporated by reference in their entireties for all purposes.

The foregoing description and examples illustrate selected embodiments of the present invention and in light thereof variations and modifications will be suggested to one skilled in the art, all of which are within the spirit and purview of this invention.

I claim:

1. A particulate detergent composition capable of dissolving completely in water, said composition comprising:

(a) 75–90% by weight of water soluble alkali metal carbonate, bicarbonate or sesquicarbonate builder salts;

(b) 1–15% by weight of non-ionic surfactants, and (c) 1–15% by weight of water, said composition being in the form of, and consisting essentially of particles having a weighted average particle size of from about 1300–2100 microns, a bulk density of form about 600–1050 grams/liter, and a weighted average particle diameter to bulk density ratio of from about 1.39–2.60 (microns) (liter)/gram.

2. The composition of claim 1, wherein the non-ionic surfactant is ethoxylated alcohol in a weight percent of about 1–4, the water content is about 5–10 weight percent, and said composition further comprises about 4–6 weight percent sodium ether sulfate, and about 1–3 weight percent sodium sulfate.

3. The composition of claim 1, wherein said composition further comprises from about 0.1 to about 5 weight percent of a polymer or polycarboxylic additive, said polymer or polycarboxylic additive being selected from the group consisting of polyacrylates, maleic acid/olefin copolymers, ethylene-maleic anhydride copolymer, methyl vinyl ether-maleic anhydride copolymer, citric acid, nitrilotriacetic acid, ethylenediamine tetraacetic acid, carboxymethyloxy succinic acid, salts of said polymers and acids, and mixtures thereof.

4. A composition as defined in claim 1, wherein the bulk density is from about 800–1000 gram/liter.

5. A composition as defined in claim 1, wherein the ratio is from about 1.68–1.88 (microns)(liter)/gram.

6. A composition as defined in claim 2, further comprising minor amounts of additives selected from the group consisting of, brighteners, perfumes, polyvinyl alcohol, and combinations of the foregoing.

7. A composition as defined in claim 3, comprising the following materials in approximate amounts by weight percent:

| | weight percent |
|---|---|
| Sodium Carbonate | 81.90 |
| Sodium Ether Sulfate | 4.30 |
| Ethoxylated Alcohol | 2.40 |
| Sodium Sulfate | 1.50 |
| Sodium Bicarbonate | 1.30 |
| Polymer Additive | 0.70 |
| Sodium Carboxymethylcellulose | 0.10 |
| Optical Brightener | 0.20 |
| Perfume | 0.10 |
| Polyvinyl Alcohol | 0.10 |
| Water | 7.40 |
| | 100.00 |

8. A composition as defined in claim 3, comprising the following materials in approximate amounts by weight percent:

| | weight percent |
|---|---|
| Sodium Carbonate | 78.40 |
| Sodium Ether Sulfate | 5.80 |
| Ethoxylated Alcohol | 3.20 |
| Sodium Sulfate | 2.00 |
| Sodium Bicarbonate | 1.80 |
| Polymer Additive | 0.90 |
| Sodium Carboxymethylcellulose | 0.10 |
| Optical Brightener | 0.20 |

-continued

| | weight percent |
|---|---|
| Perfume | 0.10 |
| Polyvinyl Alcohol | 0.10 |
| Water | 7.40 |

-continued

| | weight percent |
|---|---|
| | 100.00 |

9. A composition as defined in claim 1, wherein the composition completely dissolves in cold water having a temperature of from about 2–24° C.

10. A composition as defined in claim 9, wherein the composition completely dissolves in cold water having a temperature of from about 2–12° C.

* * * * *